US006190754B1

(12) United States Patent
Bondoc et al.

(10) Patent No.: US 6,190,754 B1
(45) Date of Patent: Feb. 20, 2001

(54) VARIEGATED SHINGLE AND METHOD OF MANUFACTURE

(75) Inventors: Alfredo A. Bondoc, Somerset; Frederick W. Sieling, Bound Brook; William R. Carroll, Sussex, all of NJ (US)

(73) Assignee: Building Materials Corporation of America, Wayne, NJ (US)

( * ) Notice: Under 35 U.S.C. 154(b), the term of this patent shall be extended for 0 days.

(21) Appl. No.: 08/997,744

(22) Filed: Dec. 24, 1997

(51) Int. Cl.[7] ..... E04D 1/28; E04D 1/26

(52) U.S. Cl. ..... 428/143; 428/144; 428/145; 428/149; 428/150; 428/195; 428/207; 52/555; 52/554; 52/518; 52/540; 52/557; 156/260; 156/264; 427/186; 427/187; 427/188; D25/139; D25/149

(58) Field of Search ..... 428/143, 144, 428/145, 149, 150, 195, 207; 52/555, 554, 518, 540, 557; 156/260, 264; 427/186, 187, 188; D25/139, 149

(56) References Cited

U.S. PATENT DOCUMENTS

| | | | |
|---|---|---|---|
| D. 48,172 | 11/1915 | Dun Lany | D25/139 |
| D. 309,027 | 7/1990 | Noone et al. | D25/139 |
| D. 313,278 | 12/1990 | Noone | D25/139 |
| D. 344,144 | 2/1994 | Weaver et al. | D25/139 |
| D. 379,672 | 6/1997 | Lamb et al. | D25/142 |
| 1,150,298 | 8/1915 | Overbury | 52/559 |
| 1,154,334 | 9/1915 | Overbury | 427/187 |
| 1,208,595 | 12/1916 | McKay | 428/207 |
| 1,295,360 | 2/1919 | Overbury | 52/555 |
| 1,583,563 | 5/1926 | Abraham | 52/554 |
| 1,593,095 | 7/1926 | Munro | 52/557 |
| 1,619,600 | 3/1927 | Cumfer | 52/529 |
| 1,898,989 | 2/1933 | Harshberger | 52/748.1 |
| 2,036,329 | 4/1936 | Giles | 428/143 |
| 2,068,118 * | 1/1937 | Topping | 52/555 |
| 2,161,440 | 6/1939 | Venrick | 52/555 |
| 2,196,847 | 4/1940 | Austin | 52/555 |
| 2,253,652 | 8/1941 | Ritter | 428/208 |
| 3,484,267 | 12/1969 | Sadler, III | 52/518 |
| 4,717,614 * | 1/1988 | Bondoc et al. | 428/143 |
| 5,347,785 | 9/1994 | Terrenzio et al. | 52/555 |
| 5,369,929 | 12/1994 | Weaver et al. | 52/557 |
| 5,611,186 | 3/1997 | Weaver | 52/557 |
| 5,666,776 | 9/1997 | Weaver et al. | 52/557 |
| 5,853,858 * | 12/1998 | Bondoc | 428/195 |

OTHER PUBLICATIONS

"Avoiding Shingle Installation Mistakes," Contractors Guide (Aug. 1988).

Brochure, Georgia–Pacific Corporation, "G–P Summit Shingles. The Built–in Shadlowline Gives A More Defined, A More Refined, Roof Texture."

Brochure, Georgia–Pacific Corporation, "Georgia–Pacific More Power To You!"

(List continued on next page.)

*Primary Examiner*—William P. Watkins, III
(74) *Attorney, Agent, or Firm*—William J. Davis; Christopher P. Foley

(57) ABSTRACT

The variegated shingle comprises a shingle layer having front and rear surfaces the front surface including a butt portion and a headlap portion. The shingle layer contains granules on the front surface forming a plurality of horizontal striations providing gradations having color values ranging from light to dark extending between a leading edge of the butt portion and an upper portion thereof. The striations include an upper striation along the upper portion, a lower striation closer to the leading edge,. and an intermediate striation between the upper and lower striations. The upper striation is darker in color value than the lower striation, whereas the intermediate striation is no darker in color value than the upper striation and no lighter in color value than the lower striation. The color values of at least one of the upper, lower, and intermediate striations vary across the granule layer.

13 Claims, 7 Drawing Sheets

OTHER PUBLICATIONS

Brochure, Celotex, "The Look of a Heavyweight 3–Dimensional Roof at a Lightweight Price."
Brochure, Celotex, "Rustic Fiber Glass Asphalt Shingles. They attract compliments and resist fire."
Brochure, Elk Corporation, "Prestique® High Definition™ Shingles. An all–time High in shingle dimension."
Brochure, "High Sierra™ Premier Heavyweight Laminated Shingles."
Brochure, Prestique® Plus, "Prestique® Plus High Definition."

* cited by examiner

VARIEGATED SHINGLE AND METHOD OF MANUFACTURE

BACKGROUND OF THE INVENTION

1. Field of Invention

The present invention relates to shingle products, such as shingles used in the roofing industry. More particularly, the present invention pertains to a shingle and method of manufacturing the shingle in which coloration along the shingle is variegated.

2. Description of Related Art

Roofing products having an outer layer of mineral or synthetic granules, such as asphalt shingles, are well known for use on roofs. Such shingles provide a relatively inexpensive alternative to wood shingles, among others. In addition, asphalt shingles are advantageous from the standpoint of fire resistance and durability. Manufacturers of asphalt shingles, however, continue to seek to replicate the thickness and shading afforded by wood shingles.

Prior attempts to enhance the appearance of thickness and corresponding depth in asphalt shingles are reflected in U.S. Pat. Nos. 5,369,929 and 5,611,186, for example. These patents disclose composite shingle products having a plurality of horizontal striations or bands. The shading, i.e. color value, of the striations differs from one striation to the next; however, the shading within each striation is substantially uniform. Consequently, the conventional striated shingle produces substantially uniform patterns of horizontal bands. The banding or checkerboard effect is exacerbated when like shingles are assembled to form a roof covering.

SUMMARY OF THE INVENTION

Accordingly, the present invention is directed to an improved shingle and method of manufacturing shingles and shingle components that substantially obviates one or more of the limitations of the related art.

To achieve these and other advantages and in accordance with the purpose of the invention, as embodied and broadly described in this application, the shingle comprises a shingle layer having front and rear surfaces, the front surface including a butt portion and a headlap portion. The shingle layer contains granules on the front surface forming a plurality of horizontal striations providing gradations having color values ranging from light to dark extending between a leading edge of the butt portion and an upper portion thereof. The striations include an upper striation along the upper portion, a lower striation closer to the leading edge, and an intermediate striation between the upper and lower striations. The upper striation is darker in color value than the lower striation, whereas the intermediate striation is no darker in color value than the upper striation and no lighter in color value than the lower striation. Significantly, the color values of at least one of the upper, lower, and intermediate striations vary across the granule layer.

In a preferred embodiment, the intermediate striation varies in color value at least once between one side of the granule layer and an opposite side.

Preferably, the shingle of the present invention is a multi-layer laminated shingle also known as a composite shingle. The roof shingle of the present invention also may be formed from a single strip single, such as a three-tabbed shingle.

In addition, the present invention comprises a method of fabricating roof shingle components from an asphalt-coated sheet comprising the steps of depositing colored granules on the asphalt-coated sheet to form continuous parallel bands shaded to provide a color gradation from light to dark on a striated portion of the sheet; and continuously varying the shading of at least one of the bands applied to the sheet.

The method of the present invention also may include the step of cutting the sheet to form a single layer strip shingle. Alternatively, the present invention contemplates cutting the sheet to form a first shingle layer having a row of tabs and openings individually interposed between consecutive ones of the tabs; cutting the striated portion of the sheet to form a second shingle layer; and securing the first shingle layer to the second shingle layer so that the striated portion of the sheet is visible through the openings.

It is to be understood that both the foregoing general description and the following detailed description are exemplary and explanatory and are intended to provide further explanation of the invention as claimed.

BRIEF DESCRIPTION OF THE DRAWINGS

The accompanying drawings are included to provide a further understanding of the invention and are incorporated in and constitute part of the specification. The drawings illustrate embodiments of the invention, and, together with their description, serve to explain the principles of the invention.

FIG. 1(*b*) is a front plan view of the shingle in FIG. 1(*a*), when assembled;

FIG. 1(*c*) is a side view taken along lines 1(*c*) in FIG. 1(*b*);

FIG. 5(*b*) is a side view taken along lines 5(*b*) of FIG. 5(*a*);

FIG. 6(*b*) is a front plan view of three rows of shingles, similar to the shingle in FIG. 6(*a*), as assembled on a roof;

FIG. 7(*b*) is a front plan view of the shingle in FIG. 7(*a*), when assembled;

FIG. 7(*c*) is a side view of FIG. 7(*b*) taken along lines 7(*c*) in FIG. 7(*b*)

DETAILED DESCRIPTION OF THE PREFERRED EMBODIMENTS

Reference will now be made to presently preferred embodiments of the invention, examples of which are illustrated in the accompanying drawings.

Figure 1A:
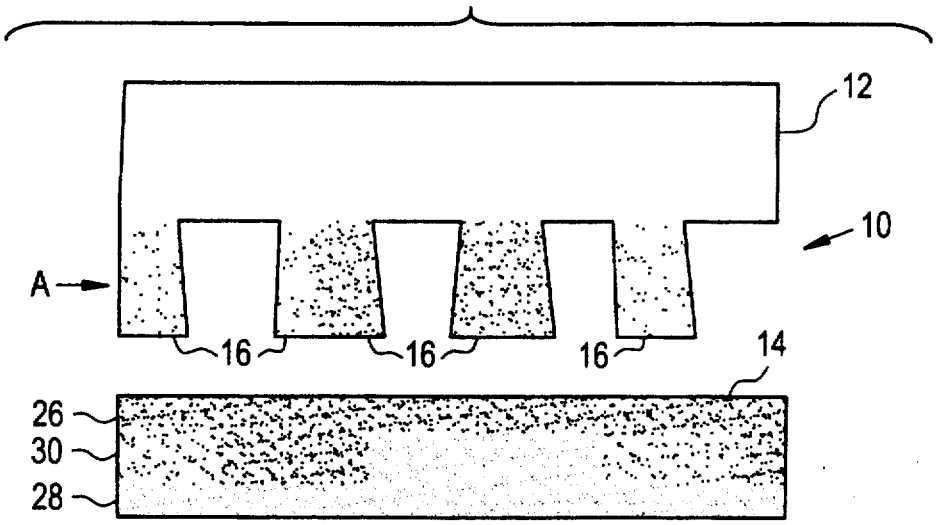
FIG. 1(*a*) is an exploded view of a preferred embodiment of the variegated shingle of the present invention.
Figure 1B:
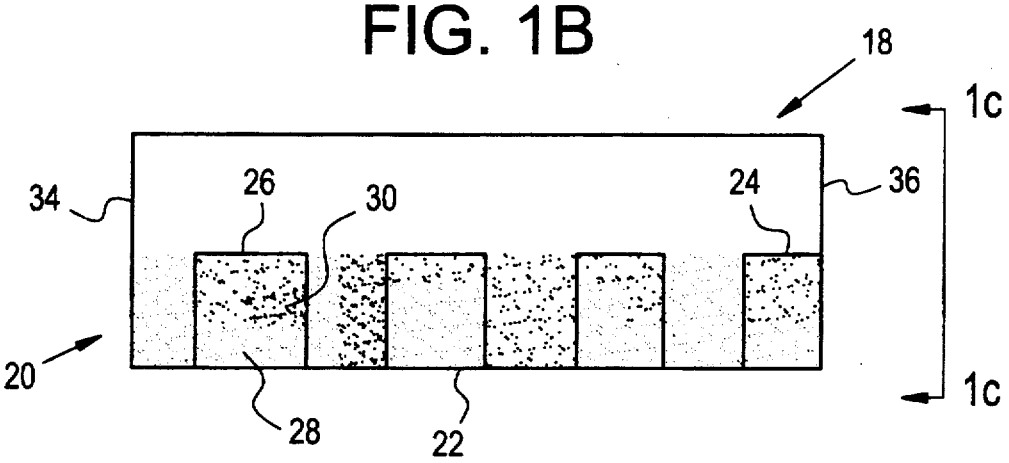
Figure 1C:
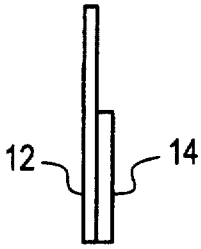

In accordance with the present invention, as shown in FIG. 1(*a*), the roof shingle 10 preferably includes a top sheet 12 and a backer sheet 14. The top sheet 12 includes a plurality of spaced tabs 16 extending in a row in the direction of arrow A. An upper portion of the top sheet 12 is referred to as a headlap portion 18, while a bottom portion, i.e. including the spaced tabs 16 of this embodiment, is known as a butt portion 20.

As shown in FIGS. 1(*a*) and 1(*b*), the backer sheet 14 is adhesively secured to the top sheet 12 to form a laminated or composite shingle. When assembled with other laminated shingles of like construction, the headlap portion 18 typically is covered substantially in its entirety by the butt portion of an adjacent shingle.

In accordance with the present invention, the backer sheet includes a plurality of horizontal striations providing gradations having color values ranging from light to dark extending between a leading edge 22 of the butt portion 20 and an upper portion 24 thereof. The striations include an upper striation 26 along the upper portion 24, a lower striation 28 closer to the leading edge 22, and an intermediate striation 30 between the upper and lower striations 26, 28.

Figure 2:
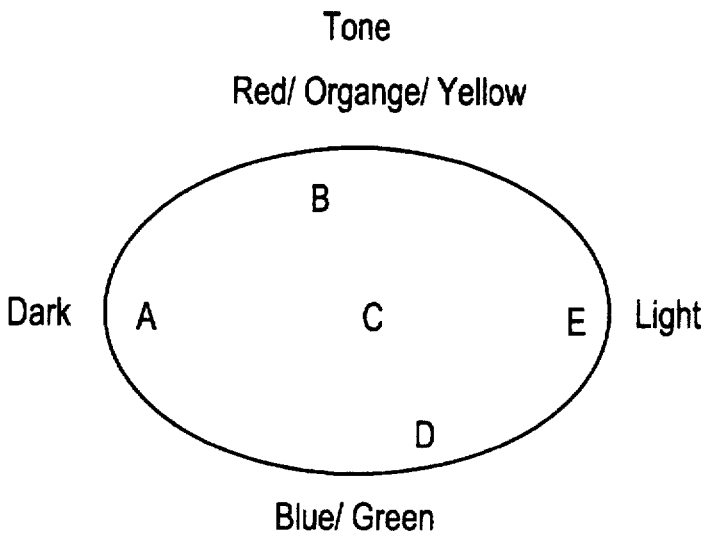
FIG. 2 is a color spectrum schematic.

FIG. 2 illustrates a schematic featuring a color spectrum or color wheel, in which a color value, based on relative lightness and darkness, is identified by reference characters A through E. As shown in FIG. 2, A is darkest, E is lightest, D is darker than E, C is darker than D, and B is darker than C.

Figure 3:
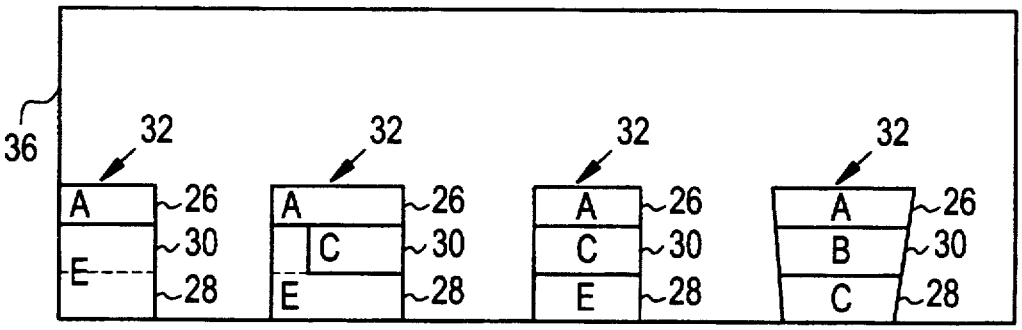
FIG. 3 is a schematic of the preferred embodiment of the present invention utilizing the color spectrum labels illustrated in FIG. 2.

In accordance with the present invention, as shown in FIG. 3 for example, the upper striation 26 is darker in color value or shading along an exposed portion of the backer sheet 14 than the lower striation 28. Exposed portions of the backer sheet are referred to in this application as color gradation portions, which are identified by reference numeral 32. The intermediate striation 30 within the color gradation portions 32 is no darker in color value than the upper striation 26 and no lighter in color than the lower striation 28.

Significantly, at least one of the upper, lower, and intermediate striations 26, 28, and 30 vary in color value from one side 34 of the shingle to an opposite side 36 along the color gradation portions 32. Preferably, the intermediate striation 30 serves as a variable band as shown in FIGS. 1(*a*) and 3; however, the preferred embodiment is not limited to relationships in shading specifically illustrated in FIGS. 1(*a*) and FIG. 3.

In accordance with the present invention, when colored granules are dropped on the asphalt sheet to form the variable band(s), the shade of the "color drop" changes typically at intervals of about every eight to sixteen inches. Inasmuch as shingles typically exceed thirty inches from one side to the other, the color value of the color drop along the variable band may change two or three times in each shingle. Indeed, the change in color value may occur along the color gradation portions.

In accordance with the present invention, there normally is at least one occurrence of adjacent striations having the same or substantially the same color. These areas are referred to as "doublets." In the preferred embodiment, in which the intermediate band 30 is the only variable band, there frequently is at least one doublet in one of the color gradation portions of the shingle. The doublets may be between the upper striation and an adjacent striation, or between an intermediate striation and the bottom striation. When making the shingles of the present invention, the pattern of shading in the horizontal striations and the occurrence of such doublets can be controlled by manipulating the horizontal length of the "drops" of colored granules and the sequence of colors used in the "color drops."

Table I, which follows, illustrates four examples of sets of color patterns that may be employed according to the present invention. The shade or color value of the striations along exposed color gradation portions of exemplary laminated shingles are indicated by the letters A, B, C, D, and E, as previously described with respect to FIG. 2. It is understood that the use of five color gradation portions, five shades of colors, and three striations is for example only. Additional shades representing additional color values may be desirable. Also, it may be desirable to utilize more than three striations or a single, continuous color gradation portion across the shingle.

TABLE I

| | | | | | | |
|---|---|---|---|---|---|---|
| Set 1 | A | A | A | A | A | |
| | C | C | C | A | C | uniform top & bottom bands; |
| | E | E | E | E | E | one doublet |
| Set 2 | A | A | A | A | A | |
| | C | E | C | A | C | uniform top & bottom bands; |
| | E | E | E | E | E | two doublets |
| Set 3 | A | B | A | A | A | |
| | C | C | C | A | C | all bands variegated; one doublet |
| | E | E | E | E | E | |
| Set 4 | A | A | B | A | A | |
| | C | E | C | A | C | all bands variegated; two doublets |
| | E | E | D | D | E | |

As shown in Table I, Set 1 comprises three striations in which the upper and lower striations are made of darker (A) and lighter (E) shades of color, respectively. The intermediate striations primarily comprises color C which is lighter than color A and darker than color E, and one portion of color A. The occurrence of color A in the intermediate striations adjacent to color A in the upper striation forms a doublet as described above.

Set 2, which comprises two doublets, illustrates that a given shingle may comprise more than one doublet and the doublets may represent adjacent areas of common or similar color between the upper and intermediate striations or between the lower and intermediate striations.

Set 3 shows a series of three striations in which the upper striation is comprised primarily of dark color A, the middle striation is comprised generally of the intermediate color C and the bottom striation is comprised of light color E. In addition, the presence of color A in the intermediate striation forms a single doublet. Color B also appears in the top striation. The presence of the doublet serves to further interrupt the banding pattern that might otherwise be formed by the use of the same color striations.

Set 4 illustrates that the striations may comprise a combination of colors or shades, provided that the intermediate striation is no darker in color value, i.e. shading, than the upper striation and no lighter in color value than the lower striation. Set 4 also illustrates a pattern in which there are two doublet areas; one between the upper and intermediate striations (adjacent areas having shade A), and one between the lower and intermediate striations (adjacent areas having shade E).

Table II shows alternative patterns which provide acceptable appearance.

TABLE II

| | | | | | | |
|---|---|---|---|---|---|---|
| Set 5 | A | A | A | B | A | |
| | C | B | C | C | C | all bands variegated; no doublets |
| | E | E | D | D | E | |

TABLE II-continued

| | | | | | | |
|---|---|---|---|---|---|---|
| Set 6 | A | A | A | B | A | |
| | B | B | B | B | B | uniform middle & bottom bands; |
| | E | E | E | E | E | one doublet |

Set 5 comprises three striations in which the upper striation is made up of color A and color B; the middle is made up of color C and one color gradation portion with color B; and the bottom striation is made up of lighter colors, e.g. E and D. In this set, the overall color gradation pattern, as well as the presence of some B in the top striation and some D in the bottom striation, form contrasting areas that serve to create an appearance of depth without using consistently uniform striations that would create a visual banding effect. In Set 5, there are no doublet portions. In Set 6, the middle striation is comprised of color B, the bottom striation is comprised of color E, and a single doublet is formed with color B along the top striation.

As will become apparent from Tables I and II, many other color mixtures can be employed to provide the aims of this invention. The color variations increase with the number of striations, the number of color shades, and the number of color gradation portion. Each of the sets described in Tables I and II provide a random appearance on a roof, particularly when combined with other shingles of similar configuration.

Figure 4:
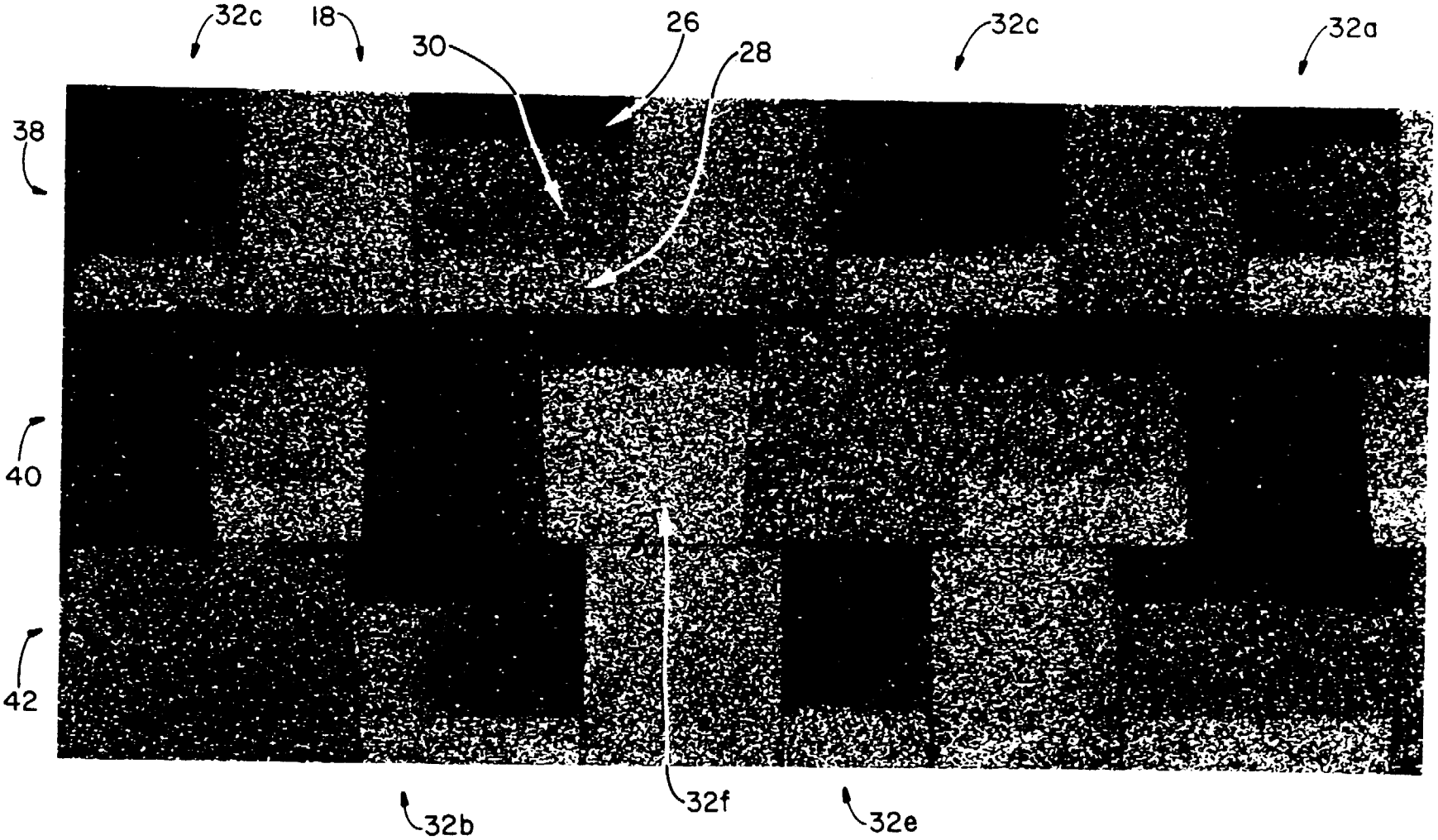
FIG. 4 is a color photograph showing three rows of shingles of the preferred embodiment as assembled on a roof.

In accordance with the present invention, FIG. 4 shows a roof covering featuring three rows 38, 40, and 42 of shingles of the preferred embodiment, in which the intermediate band 30 is the variable band. The headlap 18 for each row of shingles is concealed by the butt portion 20 of an adjacent row. As shown in FIG. 4, the color value of the upper and lower striations 26, 28 along the exposed color gradation portions 32 in each of the rows 38, 40, and 42 remains the same, while the intermediate band 30 varies.

The color gradation portions 32*a* (row 1) and 32*b* (row 3) show the intermediate striations 30 transitioning from one color mixture to another, which further eliminates any likelihood that the shingles of the present invention will produce banding patterns. In addition, the color gradation portions 32*c* (row 1), 32*d* (row 1), 32*e* (row 3) contain doublets because the upper and intermediate striations 26, 30 are substantially the same. In color gradation portion 32*f*, the intermediate band 30 has substantially the same color value as the lower band 28. In the remaining color gradation portions shown in FIG. 4, the mixture of granules forming the variable, intermediate bands 30 produces color values neither as dark nor as light as the corresponding upper and lower striations adjacent to those bands.

Figure 5A:
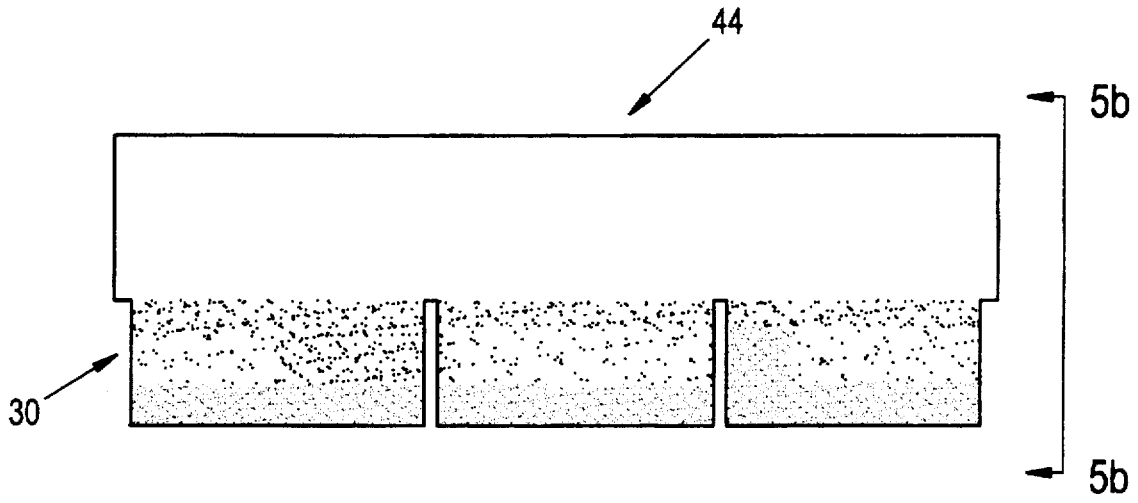
FIG. 5(*a*) is a front plan view of another embodiment of the present invention.
Figure 5B:
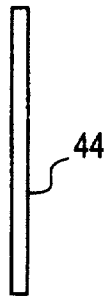
Figure 6A:
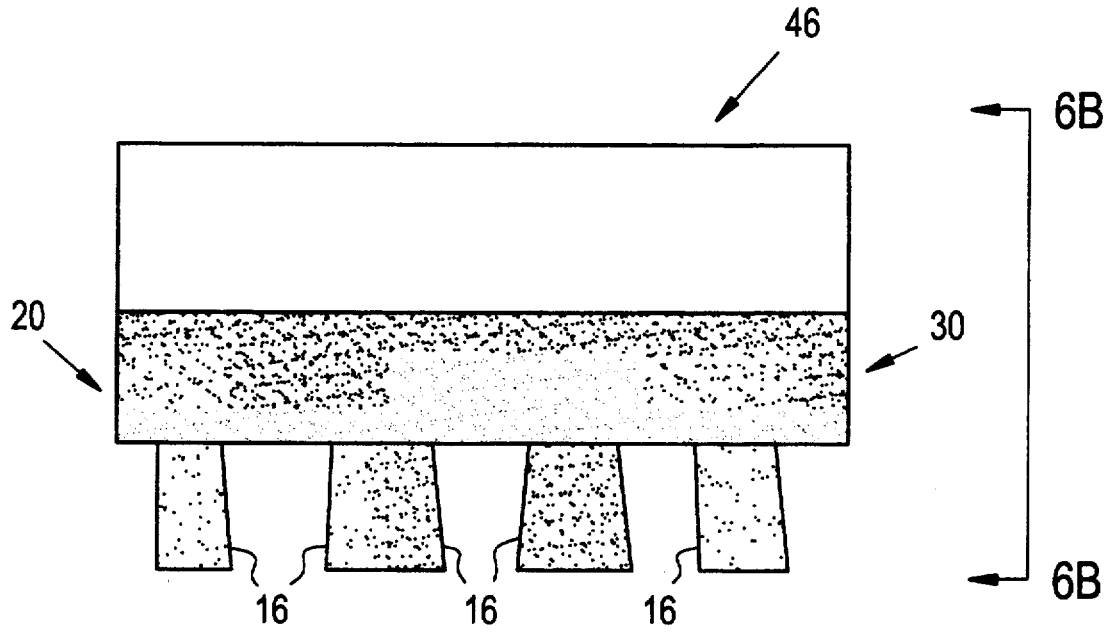
FIG. 6(*a*) is a front plan view of still another embodiment of the present invention.
Figure 6B:
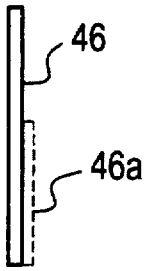
Figure 7A:
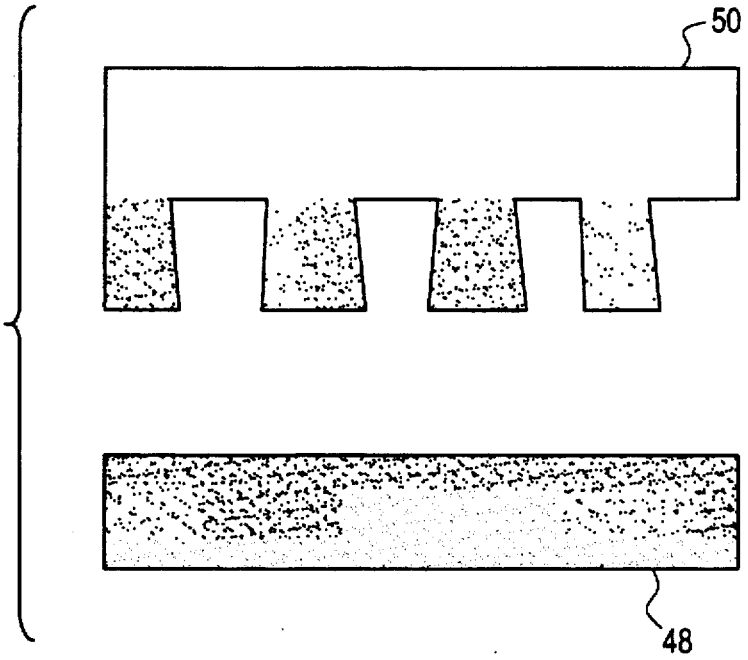
FIG. 7(*a*) is an exploded view of a further embodiment of the present invention.
Figure 7B:
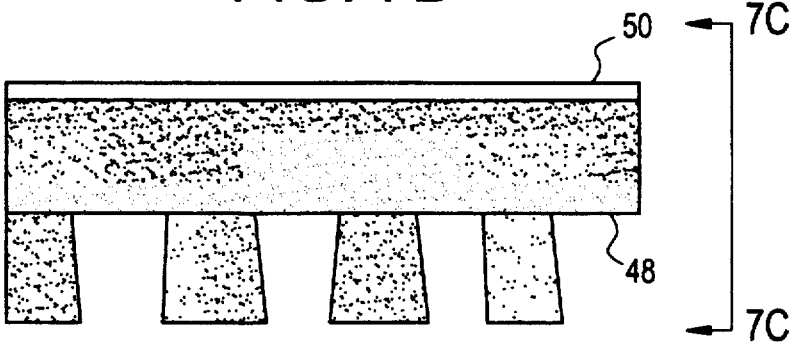
Figure 7C:
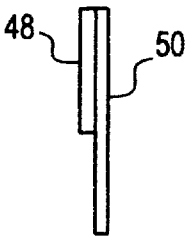

FIGS. 5(*a*) through 7(*c*) illustrate alternative embodiments of the present invention. FIGS. 5(*a*) and 5(*c*) show a three tab shingle 44 having the preferred color gradation and variable, intermediate band 30 extending across the entire shingle. In FIG. 6(*a*), a single layer shingle 46 includes a single layer of fabric having striations extending along the butt portion 20 of the shingle 46 and tabs 16 depending therefrom. Alternatively, a second piece of shingle fabric may be laminated, for example, beneath the tabs, and cut to the shape of the tabs, thereby resulting in a two layer shingle product of increased thickness. A shingle, as shown in FIG. 6(*a*), and like shingles may be assembled, as shown in FIG. 6(*b*), so that the striated portion of shingle on the upper half of the butt portions are visible through the openings between the tabs an adjacent shingle. FIGS. 7(*a*) through 7(*c*) illustrate a striated shingle layer 48 which is affixed to a headlap 18 of a tabbed layer 50. The shingle in FIGS. 7(*a*)–7(*c*) is assembled such that the striations underlie the tabs of an adjacent shingle of a similar configuration.

Figure 8:
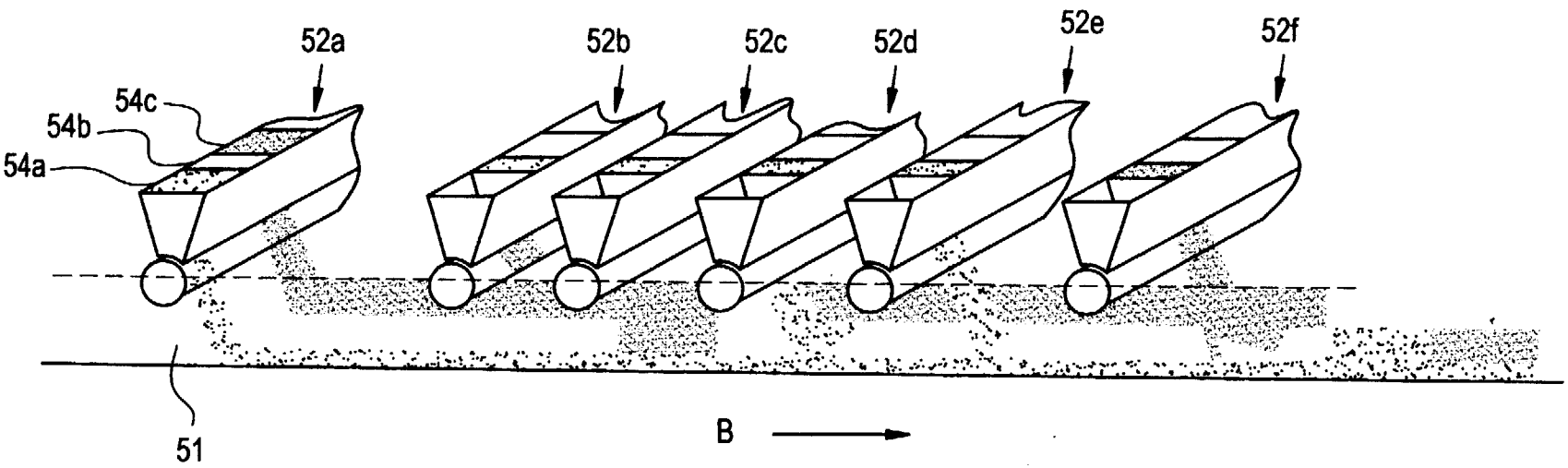
FIG. 8 is a perspective view of a granule applicator system used to apply granules in accordance with the present invention.

The present invention further includes a method of fabricating a laminated roofing shingle as generally illustrated in FIG. 8. As shown in FIG. 8, colored granules are placed on an asphalt sheet 51 from granule applicators 52(*a*)–52(*f*) which are divided into compartments 54(*a*)–(*c*). Granule applicator 52(*a*) preferably applies continuous bands of color on the asphalt sheet 51 in the direction of arrow B. The applicator 52(*a*) utilizes compartments 54(*a*) and 54(*c*), one having a relatively dark color and one having a relatively light color. Granule applicators 52(*b*)–52(*e*) utilize compartment 54(*b*) and contain, in general, colors intermediate to those applied by applicator 1. In the preferred process, at least one of the applicators 52(*b*)–52(*e*) contains color equal to the dark color in applicator 1, and one contains light color equal to the color value of the granules in applicator 52(*a*). Applicators 52(*a*)–52(*e*) are operated in a discontinuous fashion so that they apply different shades of granules in After the colored granules are placed on the asphalt-coated sheet to form bands shaded to provide a color gradation from light to dark on the sheet, as previously described, one or more sheets are cut and formed to provide various types of shingles as described in this application.

It will be apparent to those skilled in the art that various modifications and variations can be made in the structure and methodology of the present invention without departing from the spirit and scope of the invention.

Accordingly, the weather surface of the second shingle portion of the present invention may be coated with various types of mineral granules to protect the asphalt coating, to add color to the shingle, and to provide fire resistance. For some applications, ceramic coated mineral granules may be used to form the outer layer comprising the weather surface. In other embodiments, the colored granules may comprise ceramic beads (such as ceramic coated mineral granules), glass, sand, plastic, slate particles or combinations thereof. Also, a wide range of mineral colors from white to black to various shades of red, blue, green, brown, and any combination thereof, may be used to provide a shingle having the desired color.

Further, the number of horizontal striations and the width of each striation on the backer sheet (second shingle sheet) may be varied depending upon the desired aesthetic appearance of the resulting shingle. For some applications, the backer sheet may include ten or fifteen striations, each striation having a width ranging from about ¼ inch to about ½ inch.

Thus, it is intended that the present invention cover modifications and variations of this invention provided they come within the scope of the appended claims or their equivalents.

What is claimed is:

1. A roof shingle having an exposed weather surface of granular material comprising:

at least four spaced quadrilateral sections extending in a row between one side of the weather surface and an opposite side; and color gradation portions individually positioned along said row to be visible between consecutively spaced quadrilateral sections, said color gradation portions each having bands shaded to provide a color gradation from light to dark extending between a leading edge and a top thereof, said bands including a variable band, the shading of said variable band varying across the exposed weather surface.

2. The roof shingle as defined in claim 1, wherein said quadrilateral sections and said color gradation portions are formed on a single sheet.

3. The roof shingle as defined in claim 1, wherein said quadrilateral sections are tabs on a first sheet, said color gradation portions are formed on a second sheet, said second sheet being attached to said first sheet.

4. The roof shingle as defined in claim 1, wherein said color gradation portions include more than three of said bands.

5. The roof shingle as defined in claim 1, wherein said color gradation portions include a top band, an intermediate band, and a bottom band, said top band being darker than said bottom band.

6. The roof shingle as defined in claim 5, wherein said top band and said intermediate band of at least one of said color gradation portions are approximately the same in color value.

7. The roof shingle as defined in claim 5, wherein intermediate band and said bottom band of at least one of said color gradation portions are approximately the same in color value.

8. The roof shingle as defined in claim 5, wherein said intermediate band is wider than either said top band or said bottom band.

9. The roof shingle as defined in claim 1, wherein said variable band changes in color value across at least one of said color gradation portions.

10. The roof shingle as defined in claim 1, wherein said quadrilateral sections are not uniform in color value.

11. A method of fabricating roof shingle components from an asphalt-coated sheet comprising the steps of:

depositing colored mineral granules on the asphalt coated sheet to form continuous parallel bands shaded to provide a color gradation from light to dark on a striated portion of the sheet; and continuously varying the shading of at least one of said bands applied to the sheet.

12. The method as defined in claim 11, also including the step of cutting the sheet to form a strip shingle.

13. The method as defined in claim 11, also including the step of:

cutting the sheet to form a first shingle layer having a row of spaced tabs and openings individually interposed between consecutive ones of said tabs;

cutting said striated portion of said sheet to form a second shingle layer; and securing said first shingle layer to said second shingle layer so that said striated portion of the sheet is visible through said openings.

* * * * *